US006729229B1

(12) United States Patent
Wildes et al.

(10) Patent No.: US 6,729,229 B1
(45) Date of Patent: May 4, 2004

(54) BALER HAVING PRE-COMPRESSION LID STOPS AND METHOD OF OPERATION

(75) Inventors: Forrest H. Wildes, Baxley, GA (US); Emory L. Olds, Cordelle, GA (US)

(73) Assignee: IPS Balers, Inc., Baxley, GA (US)

( * ) Notice: Subject to any disclaimer, the term of this patent is extended or adjusted under 35 U.S.C. 154(b) by 0 days.

(21) Appl. No.: 10/340,182

(22) Filed: Jan. 10, 2003

Related U.S. Application Data

(62) Division of application No. 09/848,749, filed on May 3, 2001.

(51) Int. Cl.[7] ..... B30B 11/22; B30B 7/04
(52) U.S. Cl. ..... 100/41; 100/42
(58) Field of Search ..... 100/41, 42, 56, 100/61, 190, 218, 215, 232, 233, 295

(56) References Cited

U.S. PATENT DOCUMENTS 4,059,049 A * 11/1977 Tillgren ..... 100/41
4,594,942 A * 6/1986 Denneboom ..... 100/137
5,193,454 A * 3/1993 Bollegraaf ..... 100/142
5,195,429 A * 3/1993 Firpo ..... 100/96
5,421,252 A * 6/1995 Reichel ..... 100/193
5,732,617 A * 3/1998 Lollini ..... 100/7
5,832,815 A * 11/1998 Bollegraaf ..... 100/42
5,845,568 A * 12/1998 Rosser, Jr. ..... 100/190
6,196,124 B1 * 3/2001 Schaeffer ..... 100/218

FOREIGN PATENT DOCUMENTS

JP 090327823 A * 12/1997

* cited by examiner

*Primary Examiner*—Allen Ostrager
*Assistant Examiner*—Jimmy Nguyen
(74) *Attorney, Agent, or Firm*—Hugh D. Jaeger

(57) ABSTRACT

A baler having pre-compression lid stops and method of operation where stops located on a pre-compression lid prevent rotation of the pre-compression lid into the pre-crush chamber to prevent impingement of a gatherer ram with the pre-compression lid.

12 Claims, 9 Drawing Sheets

BALER HAVING PRE-COMPRESSION LID STOPS AND METHOD OF OPERATION

CROSS REFERENCES TO CO-PENDING APPLICATIONS

This patent application is a divisional of Ser. No. 09/848,749 entitled "Baler Having Pre-Compression Lid Stops and Method of Operation" filed on May 03, 2001, by the same inventors, pending.

BACKGROUND OF THE INVENTION

1. Field of the Invention

The present invention pertains to a baler and the sequenced operation thereof for baling of waste or other products, and more particularly, relates to a baler having one or more pre-compression lid stops.

2. Description of the Prior Art

Prior art baling devices, as well as present day baling devices, operate under conditions of high component stress during the process of compressing waste material, such as cardboard, rags, light metals and the like. Great force is required to compact and compress such waste material into as small a bale or bundle as practicable. Operation under conditions requiring such great force often causes undue wear of moving components designed into the structure of the baler. One area in which a great deal of force and component movement is evident is in the area of a pre-compression lid which forms, in part, a surface of a pre-crush chamber. Waste material is introduced through a hopper into the pre-crush chamber subsequent to which a pre-compression lid is forcefully and continually positioned to close the top region of the pre-crush chamber. Such constant and continual repositioning over a period of time causes pre-compression lid impinge with great force, thus causing structural damage to the gatherer ram, the pre-compression lid, and to structural items adjacent to the pre-compression lid and gatherer ram, as well as possible damage to other areas due to the improper redistribution of forces.

Clearly what is needed is a method of restricting the pre-compression lid from being positioned into the pre-crush chamber to prohibit impingement with a gatherer ram, such as is offered by the present invention, as now described.

SUMMARY OF THE INVENTION

The general purpose of the present invention is a baler having a sequenced operation and including pre-compression lid stops as described according to one or more embodiments of the present invention. There is provided a baler utilizing pre-compression lid stops to prevent entry of the pre-compression lid into the pre-crush chamber. The pre-compression lid, including a planar lid plate and an attached arced lid plate, is located in the lower hopper segment and above a pre-crush chamber and is actuated hydraulically in pivotal fashion to position the planar lid plate to form an upper surface of the pre-crush chamber to retain and to pre-compress hopper loaded material in the pre-crush chamber prior to and during movement of a gatherer ram during waste compression cycles. The attached arced lid plate prevents top loading of waste material upon the top surface of the planar lid plate and offers a suitable mounting area for pre-compression lid stops at an outboard edge of the arced lid plate. The pre-compression lid stops are incorporated to impinge against a framework mounted stop to assure movement of the pre-compression lid to a position which maintains the pre-compression lid clear of the pre-crush chamber and thus clear of the ram. The pre-compression lid stops can be adjusted by the use of shims to provide for limited pivotal rotation of the pre-compression lid about a pivot rod.

According to one embodiment of the present invention, there is provided a baler having pre-compression lid stops, including stops which secure to the baler pre-compression lid. The stops include an adjustable contact bar, a shim and a mounting bar, each of which secure transversely mounting brackets by appropriate mounting hardware.

One significant aspect and feature of the present invention is a baler incorporating pre-compression lid stops.

Yet another significant aspect and feature of the present invention is the use of pre-compression lid stops to prevent movement of a pre-compression lid into a pre-crush chamber.

Still another significant aspect and feature of the present invention is the mounting of pre-compression lid stops at one end of an arced lid plate.

A further significant aspect and feature of the present invention is the use of pre-compression lid stops to compensate for component wear, thereby preventing entry of the pre-compression lid into the pre-crush chamber and thus into the path of a ram.

A further significant aspect and feature of the present invention is the use of pre-compression lid stops which are adjustable.

A still further significant aspect and feature of the present invention is a sequenced operation of the baler incorporating pre-compression lid stops and/or proximity switches.

Another significant aspect and feature of the present invention is the incorporation of pre-compression lid stops secured to component members to minimize maintenance functions with respect to time, materials and cost.

Having thus set forth distinguishing traits of the present invention, it is one object of the present invention to provide a baler incorporating pre-compression lid stops.

Other objects of the present invention are now set forth.

Other aspects of the baler include a sequenced operation for the baling of materials by the pre-compression baler including the steps where:

1. The pre-compression lid is in the closed position with the gatherer ram and ejector ram fully retracted and the bale door closed.
2. An in-feed conveyor loads material on top of the pre-compression lid until a hopper photo-eye 49 is reached.
3. The conveyor stops and the pre-compression lid opens to allow waste into the pre-crush chamber.
4. The pre-compression lid closes until a proximity switch 124 for the pre-compression lid 26 and the pre-compression lid stops (mechanical stops) are reached.
5. The gatherer ram cycles forward until bale made PSI as measured by pressure sensor 120 and gatherer ram distance are reached. If gatherer ram forward proximity switch 122 is reached, the gatherer ram retracts to the fully retracted position and returns to step 1. If a bale is made, move to step 6.
6. The gatherer positions for the eject cycle.
7. The bale door opens.
8. The ejector ram moves forward and straps are placed on the bale as the bale is ejected.
9. The ejector retracts to full retract.

10. The bale door extends to close.

11. The gatherer retracts to the full retracted position and returns to step 1.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
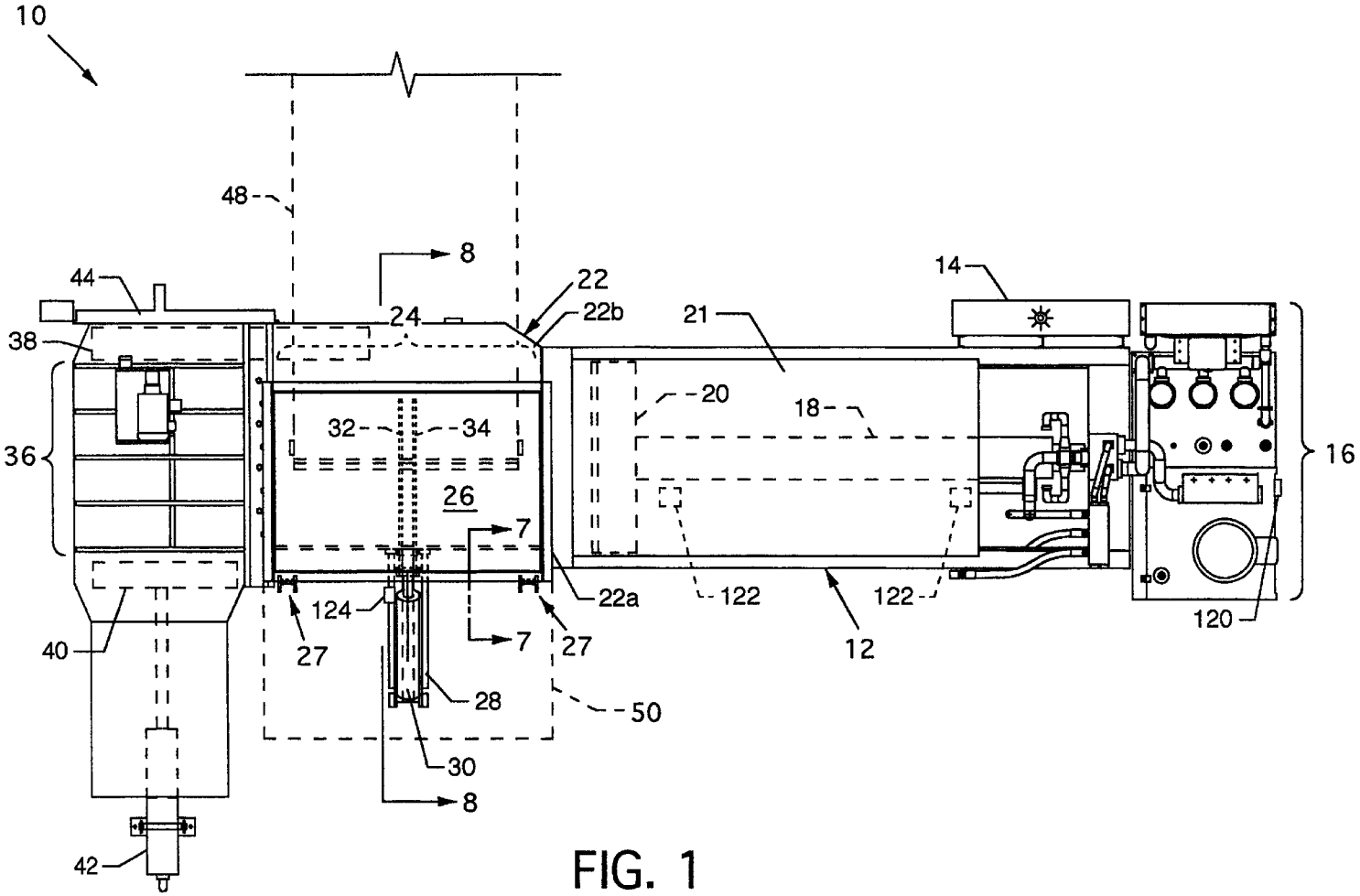
FIG. 1 illustrates a top view of a baler with pre-compression lid stops.
Figure 2:
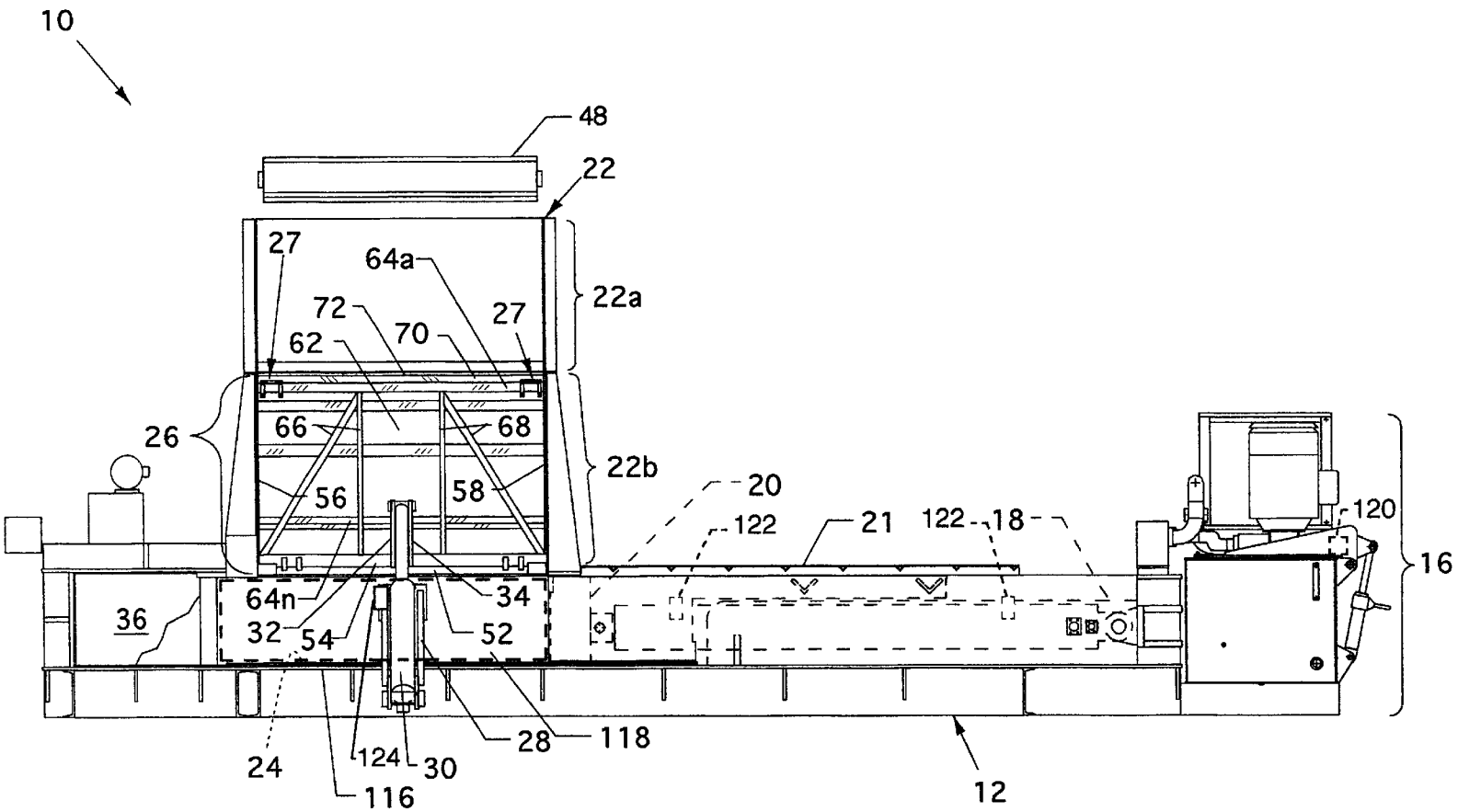
FIG. 2 illustrates a side view in partial cutaway of the baler with pre-compression lid stops with the ejector components removed.

FIG. 1 illustrates a top view, and FIG. 2 illustrates a side view in partial cutaway of the baler with pre-compression lid stops 10 with the ejector components removed. With reference to FIGS. 1 and 2, the invention is now described. The baler with pre-compression lid stops 10 includes major components most of which mount on a framework 12 or on other structure shown in FIGS. 1 and 2, including an electric control panel 14, a hydraulic power unit 16, a hydraulic ram actuator cylinder 18 and gatherer ram 20 shown generally in a ram component housing 21, a hopper 22 comprised of an upper hopper segment 22*a* and a lower hopper segment 22*b* aligned and secured over and above a pre-crush chamber 24 (FIGS. 2, 8 and 9) shown generally in dashed lines, a pre-compression lid 26 (in the closed position) pivotally secured to an upper region of the framework 12, residing during operation in the lower hopper segment 22*b*, and located just above the pre-crush chamber 24, similarly fashioned stops 27 at an upper edge of the pre-compression lid 26, a pre-compression lid hydraulic cylinder actuator support structure 28 secured to and extending outwardly from the framework 12, a pre-compression lid hydraulic cylinder actuator 30 secured between the outboard end of the pre-compression lid hydraulic cylinder actuator support structure 28 and support ribs 32 and 34 of the pre-compression lid 26, a bale chamber 36 adjacent to the pre-crush chamber 24, a bale door 38 at one end of the bale chamber 36, an ejector ram 40 and ejector ram hydraulic actuator 42, a strapper 44, and a-conveyor 48 shown in dashed lines which delivers material to the hopper 22. A protective enclosure 50 (FIGS. 1, 3 and 9) which guards personnel from movement of the pre-compression lid 26 is shown in dashed lines.

Figure 3:
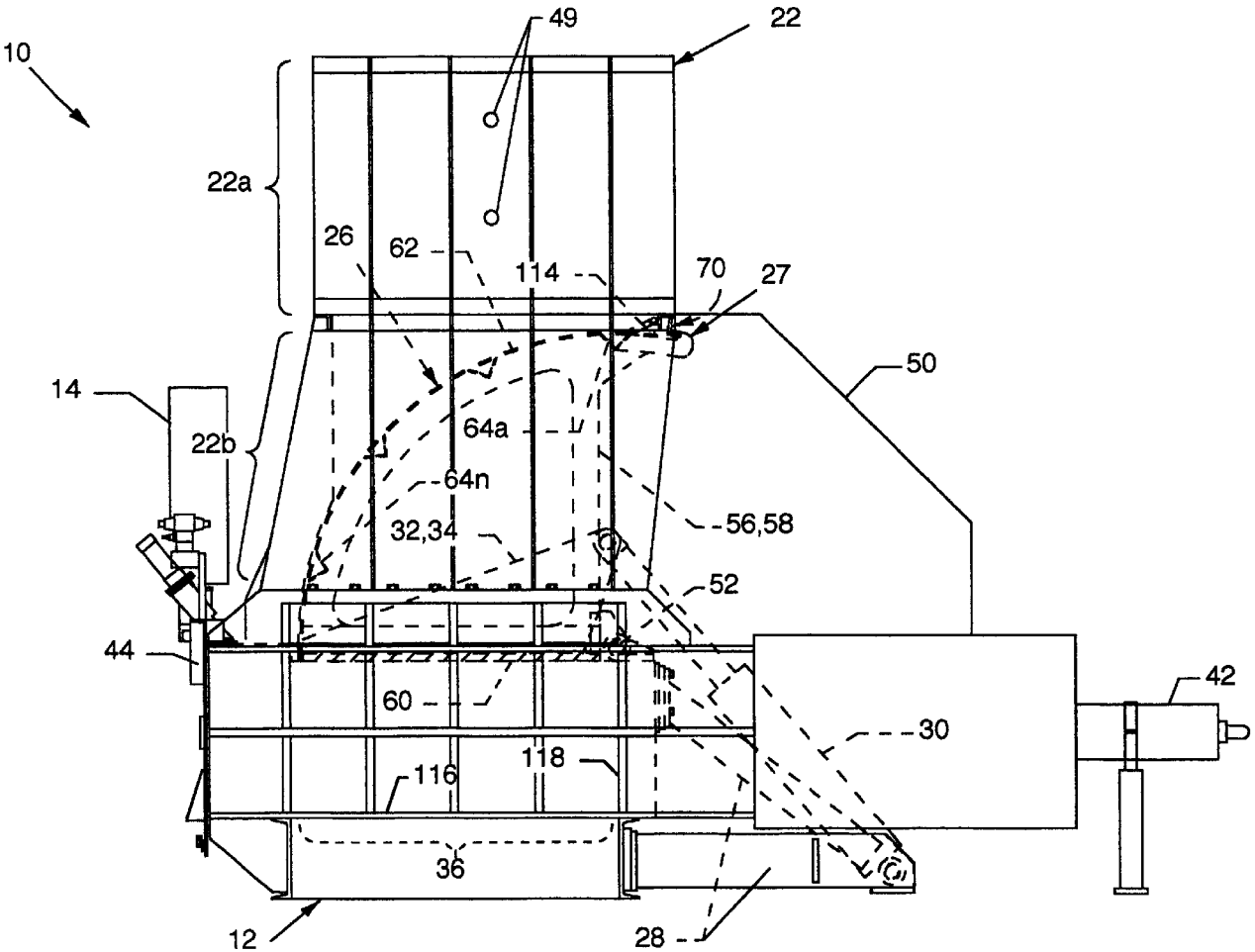
FIG. 3 illustrates an end view of the baler with pre-compression lid stops.
Figure 7:
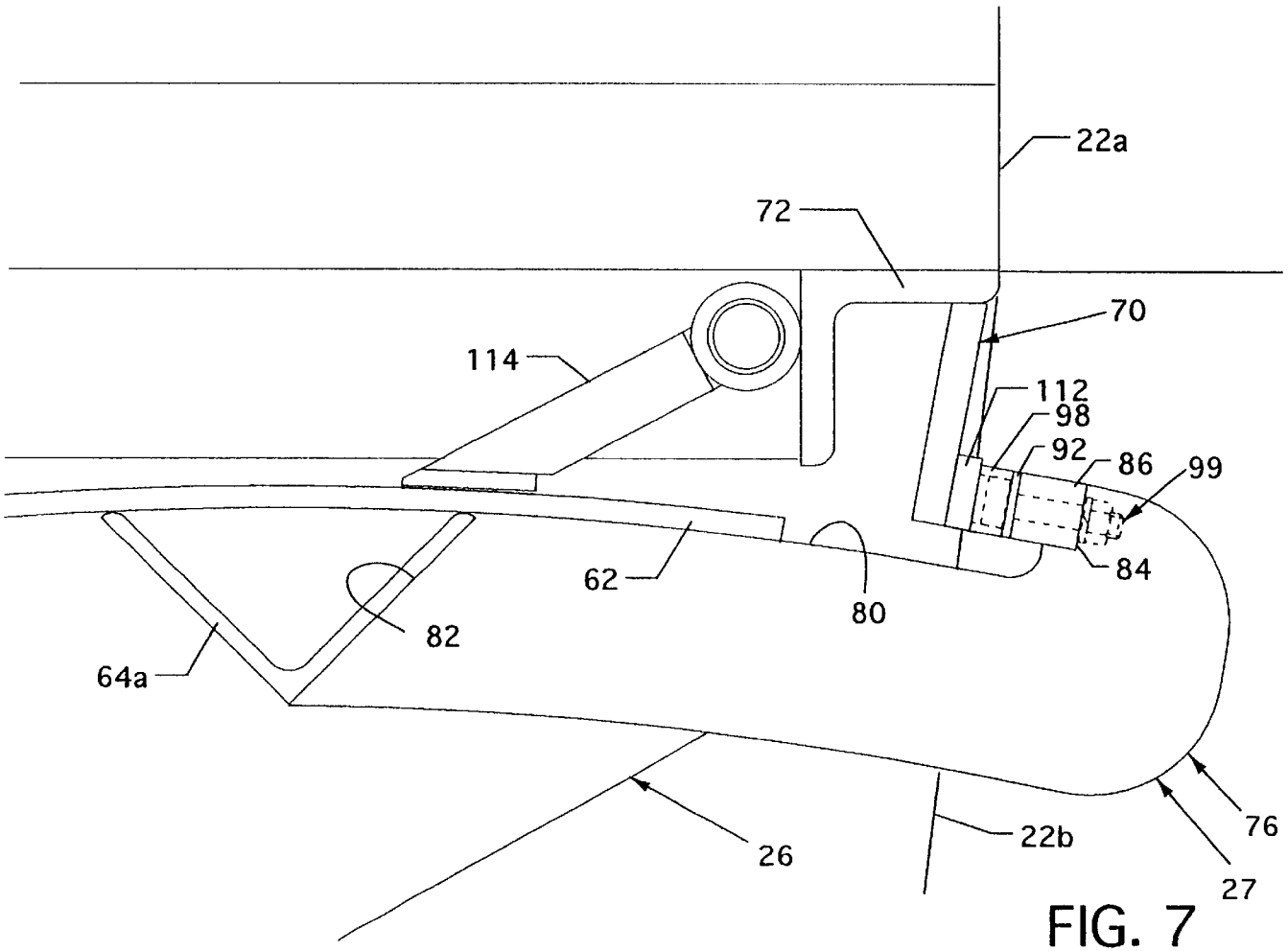
FIG. 7 illustrates a view of the region of contact of a stop with the pre-compression lid along line 7—7 of FIG. 1.

FIG. 2 also shows a side view of the pre-compression lid 26 in the closed position. Major components of the pre-compression lid 26 include a planar lid plate 60 and an intersecting arced lid plate 62 (FIGS. 2, 3, 4, 8 and 9). Horizontally aligned angle supports 64*a*–64*n* are secured to the inner surface of the arced lid plate 62 and extend between the side supports 56 and 58 which extend vertically between the planar plate lid 60 and the arced lid plate 62 (FIG. 3). A pivot rod 52 pivotally connects the pre-compression lid 26 to the framework 12 via a horizontally aligned bracket 54. The horizontally aligned bracket 54 aligns between the lower edges of the side supports 56 and 58 and along one edge of the planar lid plate 60 as does pivot rod 52. Additional bracing 66 and 68 extends between the upper edge of the arced lid plate 62 and the bracket 54. As also shown in FIG. 7, the stops 27 secure to the angle support 64*a* and to the upper edge region of the arced lid plate 62. A horizontally aligned stop angle 70 extends downwardly from a horizontally aligned angled support bracket 72 located across the junction of the upper and lower hopper segments 22*a* and 22*b*, as also shown in FIG. 7.

Figure 8:
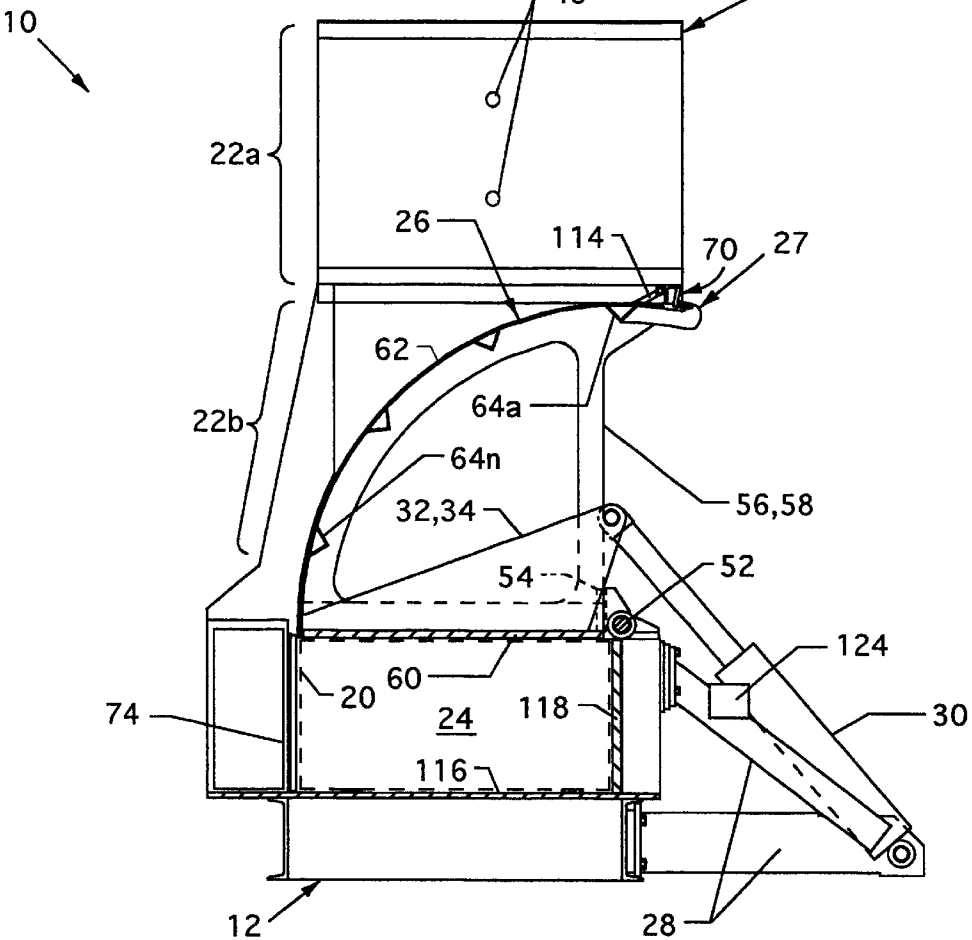
FIG. 8 illustrates a cross section view of the pre-crush chamber along line 8—8 of FIG. 1; and, FIG. 9 illustrates the members shown in FIG. 8 where the pre-compression lid is positioned in the open position to accept waste.

FIG. 3 illustrates an end view of the baler with pre-compression lid stops 10. The pre-compression lid 26, shown in dashed lines, is illustrated in the closed position and presently residing substantially in the lower hopper segment 22*b*. The planar lid plate 60 is oriented to function as the top of the pre-crush chamber 24, as shown in FIG. 8. The stop(s) 27 impinge the structure of the stop angle 70 to properly position the pre-compression lid 26 with respect to the pre-crush chamber 24 and the gatherer ram 20 shown in other figures.

Figure 4:
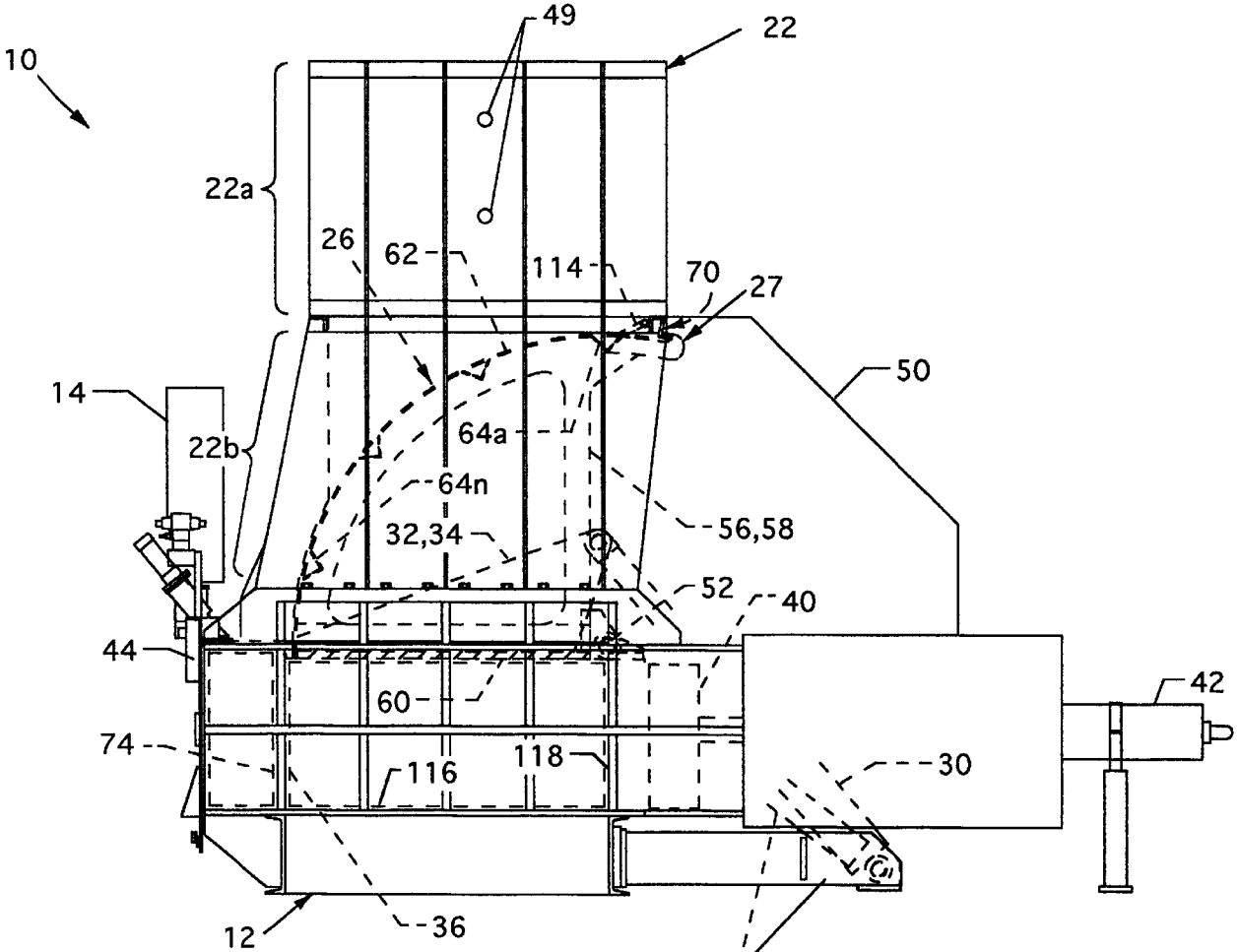
FIG. 4 illustrates an end view of the baler with pre-compression lid stops.

FIG. 4 illustrates an end view of the baler with pre-compression lid stops 10, including the elements shown in FIG. 3, with the addition of a bale door 74, the ejector ram 40, and the bale chamber 36, each shown representatively in simplified form as dashed lines.

Figure 5:
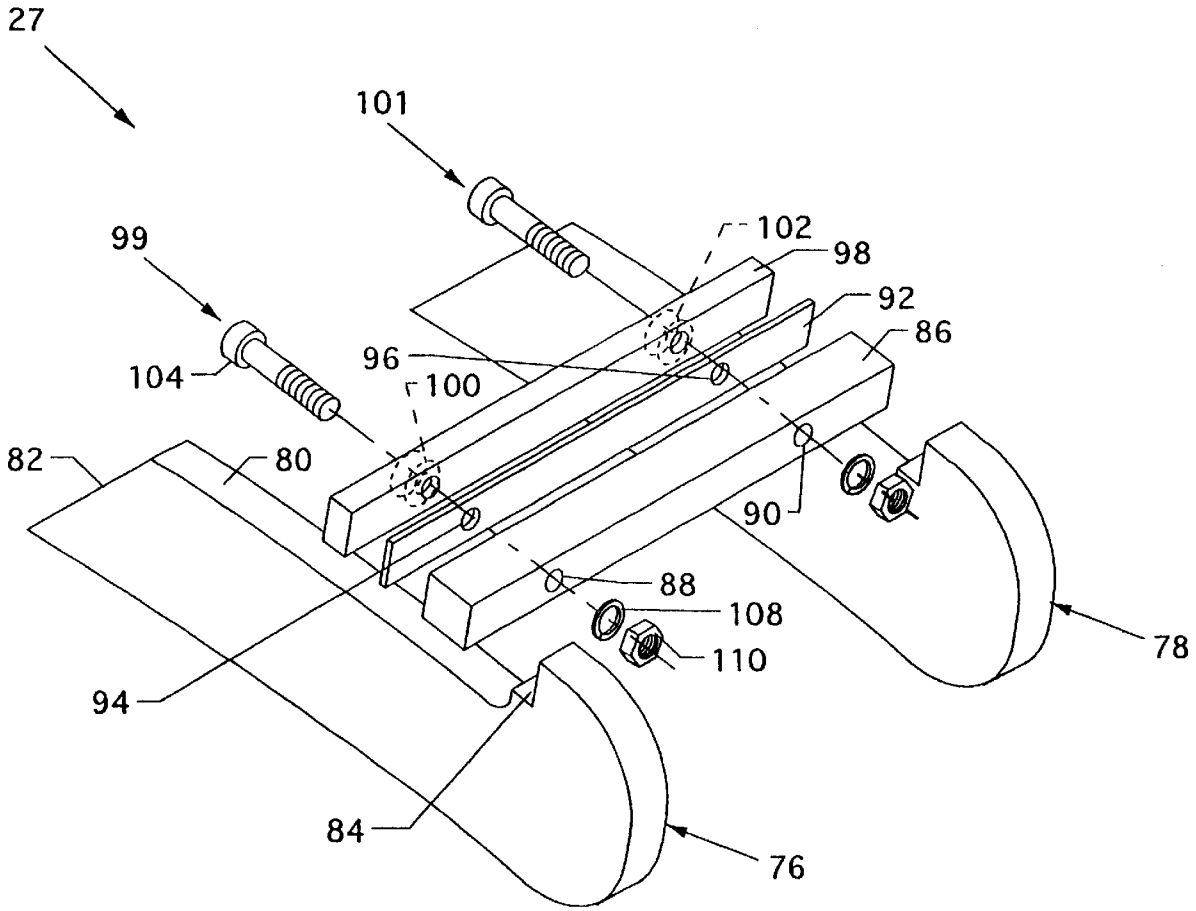
FIG. 5 illustrates an exploded isometric view of a lid stop.
Figure 6:
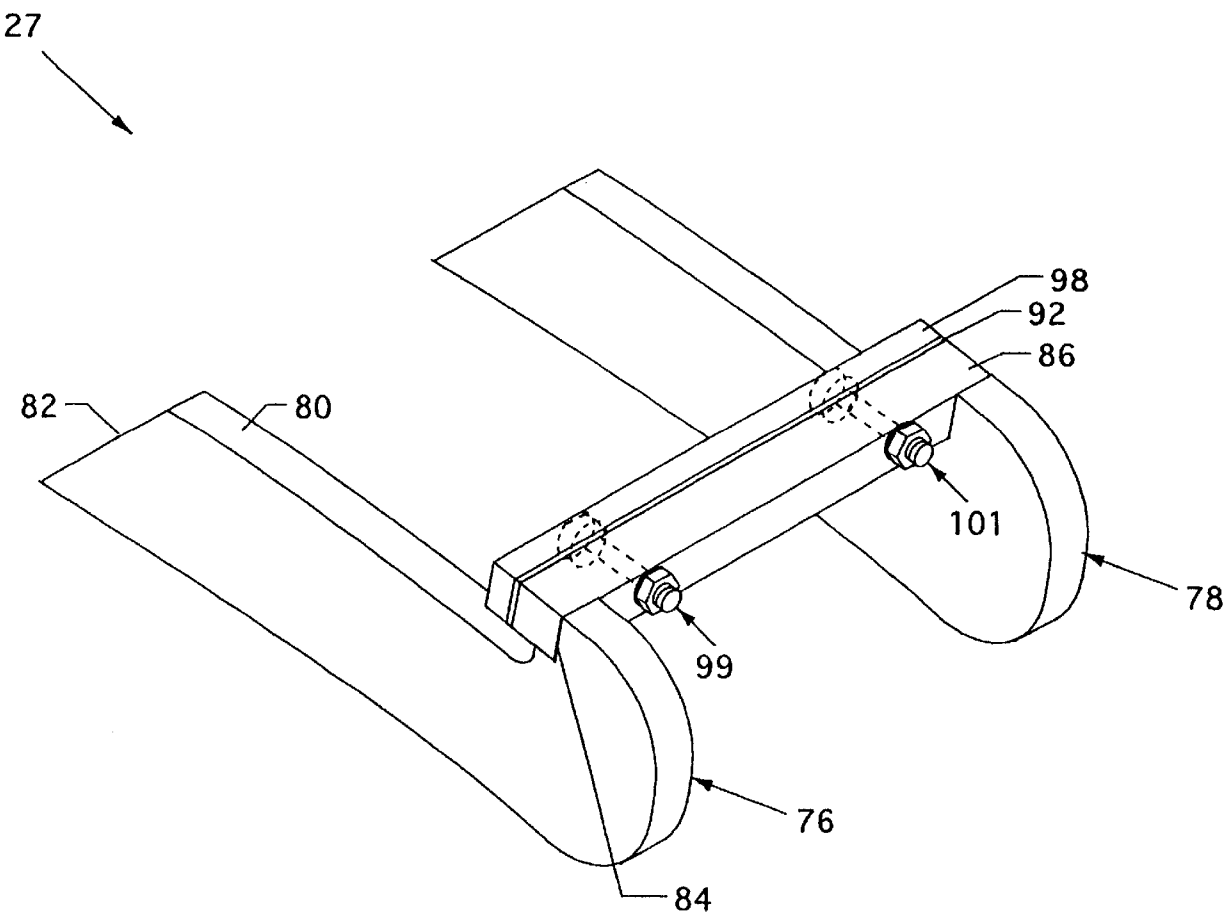
FIG. 6 illustrates an assembled isometric view of a lid stop.

FIG. 5 illustrates an exploded isometric view of a stop 27, and FIG. 6 illustrates an assembled isometric view of the stop 27. The stop 27, which is adjustable, includes similarly fashioned opposed mounting brackets 76 and 78 and other components as now described. Mounting bracket 76 (and 78) includes an upper curved edge 80, and at opposing ends, an angled rearwardly facing angled edge 82, and a rearwardly facing mounting notch 84. A mounting bar 86 including body holes 88 and 90 aligns and is secured such as by welding transversely between the mounting notches 84 of the mounting brackets 76 and 78. A shim 92 of suitable material and thickness including body holes 94 and 96, which in the alternative could be open slots, aligns adjacent to and inwardly from the mounting bar 86. A contact bar 98 including multi-radius body holes 100 and 102 aligns adjacent to and inwardly from the shim 92. Two sets of similar hardware assemblies 99 and 101 include a bolt 104, a lock-washer 108 and a nut 110 which engage body holes 88, 90, 94, 96, and multi-radius body holes 100 and 102 of the mounting bar 86, the shim 92 and the contact bar 98, respectively. The larger radius portions of the multi-radius body holes 100 and 102 are incorporated as recesses to allow the heads of the bolts 104 to be recessed from the inwardly facing edge of the contact bar 98 to provide a smooth contact surface.

FIG. 7 illustrates a view of the region of contact of the stop 27 with the pre-compression lid 26 along line 7—7 of FIG. 1 to limit movement of the pre-compression lid 26 beyond a point where any member of the pre-compression lid 26 would enter the pre-crush chamber 24 shown in FIGS. 1 and 8. The upper curved edge 80 of the mounting bracket 76 (and 78) secures, such as by welding, to the region near one end of the arced lid plate 62, and the rearwardly facing angled edge 82 of the mounting bracket 76 (and 78) secures to the angle support 64*a*, such as by welding, thus providing suitable attachment of the stop(s) 27 to the pre-compression lid 26. A contact plate 112 is secured to one surface of the stop angle 70 to serve as an interface and as a point of contact between the stop 27 and the pre-compression lid 26. A wiper bar 114 which is incorporated to prevent the pre-compression lid 26 from dragging material out of the upper hopper segment 22*a* is also shown.

FIG. 8 illustrates a cross section view of the pre-crush chamber 24 along line 8—8 of FIG. 1 showing alignment of the pre-crush lid 26 to the pre-crush chamber 24. The pre-crush chamber 24 is formed by appropriate regions of a bottom plate 116, a side plate 118, the bale door 74 and the planar lid plate 60 of the pre-compression lid 26. A profile of the gatherer ram 20 is shown in dashed lines. Stop(s) 27 engages the stop angle 70 via the contact plate(s) 112 (FIG. 7) to prevent rotation of the planar lid plate 60 or any other member of the pre-compression lid 26 into the pre-crush chamber 24 and into the path of the gatherer ram 20. In this position, the lid hydraulic cylinder actuator 30 is exercised to the limit of its travel in order to pre-crush waste occupying the pre-crush chamber 24 by applied pressure thereupon by the pre-compression lid 26. The impingement of the stop(s) 27 with the stop bar 70 is sufficient to overcome any hydraulic pressure inadvertently or purposely applied by the lid hydraulic cylinder actuator 30 which would tend to position the pre-compression lid 26 into the pre-crush chamber 24 and into the path of the gatherer ram 20.

Figure 9:
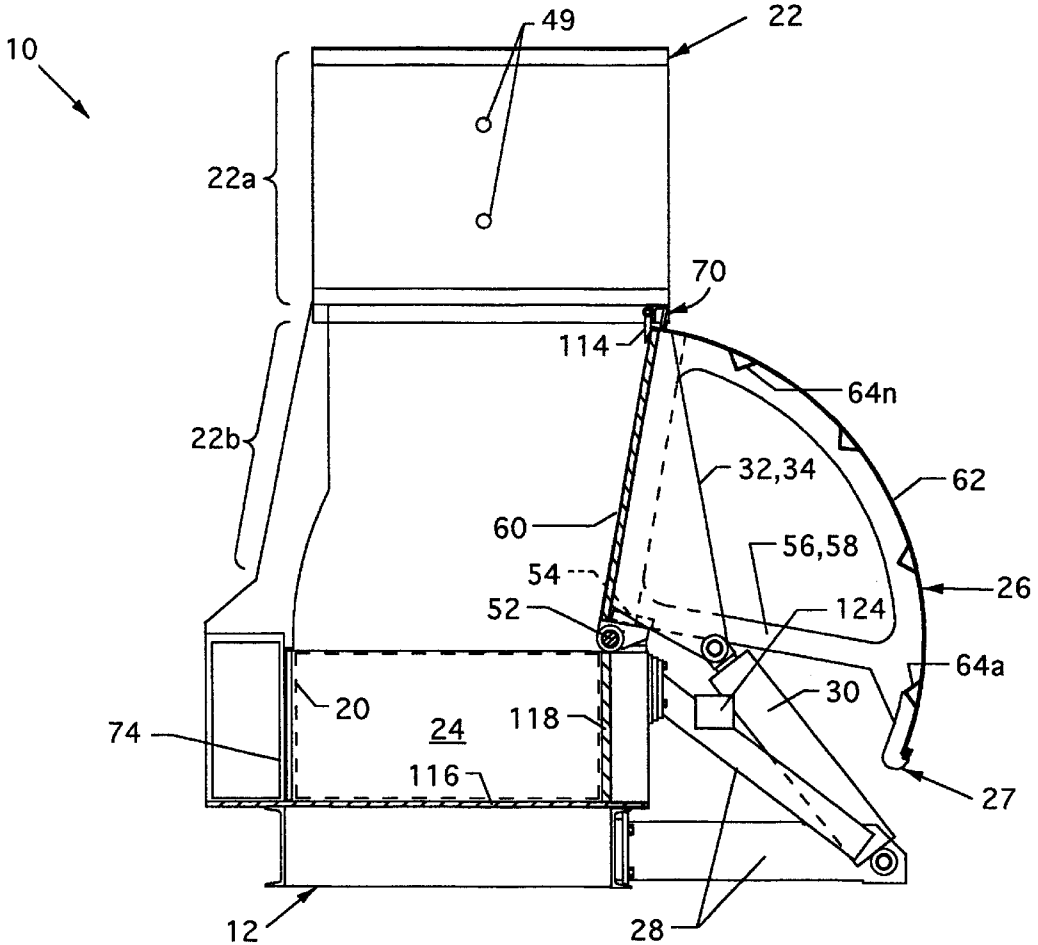

FIG. 9 illustrates the members shown in FIG. 8 where the pre-compression lid 26 is positioned in the open position to accept waste through the hopper 22.

Mode of Operation

Other aspects of the baler include a sequenced operation for the baling of materials by the pre-compression baler including the steps where:

1. The pre-compression lid is in the closed position with the gatherer ram and ejector ram fully retracted and the bale door closed.
2. An in-feed conveyor loads material on top of the pre-compression lid until a hopper photo-eye 49 is reached.
3. The conveyor stops and the pre-compression lid opens to allow waste into the pre-crush chamber.
4. The pre-compression lid closes until a proximity switch 124 for the pre-compression lid 26 and the pre-compression lid stops (mechanical stops) are reached.
5. The gatherer ram cycles forward until bale made PSI as measured by pressure sensor 120 and gatherer ram distance are reached. If gatherer ram forward proximity switch 122 is reached, the gatherer ram retracts to the fully retracted position and returns to step 1. If a bale is made, move to step 6.
6. The gatherer positions for the eject cycle.
7. The bale door opens.
8. The ejector ram moves forward and straps are placed on the bale as the bale is ejected.
9. The ejector retracts to full retract.
10. The bale door extends to close.
11. The gatherer retracts to the full retracted and returns to step 1.

Various modifications can be made to the present invention without departing from the apparent scope hereof.

BALER HAVING PRE-COMPRESSION LID STOPS AND METHOD OF OPERATION PARTS LIST

| | |
|---|---|
| 10 | baler with pre-compression lid stops |
| 12 | framework |
| 14 | electric control panel |
| 16 | hydraulic power unit |
| 18 | hydraulic ram actuator cylinder |
| 20 | gatherer ram |
| 21 | ram component housing |
| 22 | hopper |
| 22a | upper hopper segment |
| 22b | lower hopper segment |
| 24 | pre-crush chamber |
| 26 | pre-compression lid |
| 27 | lid stop |
| 28 | pre-compression lid hydraulic cylinder actuator support structure |
| 30 | pre-compression lid hydraulic cylinder actuator |
| 32 | support rib |
| 34 | support rib |
| 36 | bale chamber |
| 38 | bale door |
| 40 | ejector ram |
| 42 | ejector ram hydraulic actuator |
| 44 | strapper |
| 48 | conveyor |
| 50 | protective enclosure |
| 52 | pivot rod |
| 54 | bracket |
| 56 | side support |
| 58 | side support |
| 60 | planar lid plate |
| 62 | arced lid plate |
| 64a-n | angle supports |
| 66 | bracing |
| 68 | bracing |
| 70 | stop angle |
| 72 | angled support bracket |
| 74 | bale door |
| 76 | mounting bracket |
| 78 | mounting bracket |
| 80 | upper curved edge |
| 82 | angled edge |
| 84 | mounting notch |
| 86 | mounting bar |
| 88 | body hole |
| 90 | body hole |
| 92 | shim |
| 94 | body hole |
| 96 | body hole |
| 98 | contact bar |
| 99 | hardware assembly |
| 101 | hardware assembly |
| 100 | multi-radius body hole |
| 102 | multi-radius body hole |

-continued

| BALER HAVING PRE-COMPRESSION LID STOPS AND METHOD OF OPERATION PARTS LIST | |
|---|---|
| 104 | bolt |
| 108 | lock washer |
| 110 | nut |
| 112 | contact plate |
| 114 | wiper bar |
| 116 | bottom plate |
| 118 | side plate |

What is claimed is:

1. A process for baling materials comprising the steps of:

a. providing a pre-compression lid baler having a hopper with an upper hopper segment and a lower hopper segment, a pre-crush chamber beneath the hopper and a hydraulically actuated gatherer ram horizontally moveable through the pre-crush chamber, the pre-crush chamber having a bottom plate and a side plate, the gatherer ran having a retracted mode and an extended compression mode, a hydraulically actuated pre-compression lid pivotally mounted to the side plate above the bottom plate to rotate from an open position allowing passage of material through the hopper into the pre-crush chamber to a closed position forming a top of the pre-crush chamber, and at least one pre-compression lid stop preventing the pre-compression lid from entering the pre-crush chamber in the closed position by contact with a pre-compression lid stop angle;

b. loading materials to be baled into the upper hopper segment;

c. opening the pre-compression lid to allow loading of materials into the pre-crush chamber;

d. rotating the pre-compression lid from the open position to the closed position and into limiting contact with the pre-compression lid stop angle while the gatherer ram is in the retracted mode, thereby urging the materials to be baled into the pre-crush chamber and pre-compressing the materials to be baled within the pre-crush chamber; and, e. actuating the gatherer ram from the retracted mode to the extended compression Mode, thereby compressing the pre-compressed materials within the pre-crush chamber into a bale while avoiding inadvertent movement of the pre-compression lid into the pre-crush chamber.

2. The process of claim 1, wherein steps b, c, d and e are repeated so as to add additional pre-compressed material to the bale until the bale is a desired size.

3. The process of claim 1, wherein the pre-compression lid stop is one of a pair of pre-compression lid stops.

4. The process of claim 1, wherein the pre-compression lid includes a planar lid plate and an intersecting arced lid plate attached to the planar lid plate and wherein the pre-compression lid stop is carried on the arced lid plate and contacts a stationary stop angle when the planar lid plate forms a top for the pre-crush chamber and the pre-compression lid is in the closed position.

5. The process of claim 1, further comprising the step of attaching a shim on the pre-compression lid stop to limit the travel of pre-compression lid and properly position the pre-compression lid with respect to the gatherer ram and the pre-chamber.

6. The process of claim 1, wherein the pre-compression lid baler further includes means for detecting gatherer ram pressure and further comprising the step of retracting the gatherer ram when a desired pressure is present at the gatherer ram.

7. The process of claim 1, wherein the pre-compression lid baler further includes means to sense gatherer ram compression position and further comprising the step of retracting the gatherer ram when a desired position is present at the gatherer ram.

8. The process of claim 2, wherein the pre-compression lid baler further includes means to detect gatherer ram pressure and means to detect gatherer ram compression position and further comprising the step of monitoring both gatherer ram compression pressure and gatherer ram compression position to determine whether the bale is a desired size and cease repeating steps b, c, d and e.

9. The process of claim 1, wherein the pre-compression lid baler includes a material detector in the hopper to indicate whether more materials should be loaded into the hopper.

10. The process of claim 9, wherein the materials are loaded into the hopper from a conveyor and the conveyor is controlled by the material detector.

11. The process of claim 9, wherein the material detector is a photo eye.

12. The process of claim 1, wherein the pre-compression lid baler further included a wiper bar to prevent the pre-compression lid from dragging materials from the pre-crush chamber when rotating from the closed to the open position and further comprising the step of wiping the arced lid plate of the pre-compression lid when rotating from the closed to the open position.

* * * * *